US006679312B2

(12) United States Patent
Hayashi et al.

(10) Patent No.: US 6,679,312 B2
(45) **Date of Patent: *Jan. 20, 2004**

(54) INJECTION MOLDING SCREW FOR METALS

(75) Inventors: Yuji Hayashi, Sakaki-machi (JP); Mamoru Miyagawa, Sakaki-machi (JP)

(73) Assignee: Nissei Plastic Industrial Co., Ltd., Nagano-ken (JP)

( * ) Notice: Subject to any disclaimer, the term of this patent is extended or adjusted under 35 U.S.C. 154(b) by 44 days.

This patent is subject to a terminal disclaimer.

(21) Appl. No.: 09/740,629

(22) Filed: Dec. 19, 2000

(65) Prior Publication Data

US 2001/0006099 A1 Jul. 5, 2001

(30) Foreign Application Priority Data

Dec. 28, 1999 (JP) ..... 11-375383

(51) Int. Cl.[7] ..... B22D 17/00
(52) U.S. Cl. ..... 164/312
(58) Field of Search ..... 164/312, 316, 164/113, 900; 366/78, 79

(56) References Cited

U.S. PATENT DOCUMENTS 5,040,589 A * 8/1991 Bradley et al. ..... 164/113
5,143,736 A * 9/1992 Kumamura et al. ..... 425/567
5,680,894 A * 10/1997 Kilbert ..... 164/312
5,983,978 A * 11/1999 Vining et al. ..... 164/312
6,588,486 B1 * 7/2003 Takayama et al. ..... 164/113

FOREIGN PATENT DOCUMENTS

WO WO 97/21509 * 6/1997 ..... B22D/17/00

* cited by examiner

*Primary Examiner*—M. Alexandra Elve
*Assistant Examiner*—Kevin P. Kerns
(74) *Attorney, Agent, or Firm*—Weingarten, Schurgin, Gagnebin & Lebovici LLP

(57) ABSTRACT

An injection molding screw prevents materials from being left and reduces friction by limiting the end position of the screw flight in relation to the position of the feeding opening in the heating cylinder. The screw is rotationally and movably provided in the heating cylinder having a nozzle at a tip end. Granular metals fed from a feeding opening at the rear of the heating cylinder are transferred forward by the screw rotation and melted. Melted metals are injected from the nozzle by forward movement of the screw. A rear end of the screw flight is positioned below the rear edge of the feeding opening at the rearmost position of the screw. At the foremost position of the screw, the rear end is positioned in front of the feeding opening to close the feeding opening by the rear portion of the axial portion of the screw axis.

2 Claims, 2 Drawing Sheets

INJECTION MOLDING SCREW FOR METALS

BACKGROUND OF THE INVENTION

1. Field of the Invention

The present invention relates to an injection molding screw for metals which is used for melting and injection molding non-ferrous metals including zinc, magnesium or the alloys thereof having a low melting point.

2. Detailed Description of the Related Art

The molding of non-ferrous metals including lead, zinc, magnesium and tin having a low melting point or the alloys thereof used to be conducted by a die-casting. By employing injection molding methods similar to that for plastic materials, the molding process is being simplified and the precision of the molding is being improved.

Notwithstanding the above, a difference in melting process between plastics and metals causes some problems.

FIGS. 3 and 4 show an apparatus to be used for injection molding. The apparatus has a nozzle 2 on the end, and a heating cylinder 1 with a feeding opening 3 on the rear thereof. The heating cylinder 1 contains a screw 7 for injection so as to be rotational and movable thereinside. The screw 7 is provided with a conical tip end 4 and a screw flight 6 around an axis 5 thereof.

In the injection molding of a plastic material, the plastic material is melted by a shear heat generated by the rotation of screw plasticization. Once injecting the metered melting plastic material by the fore end portion of the heating cylinder through forwarding the screw, during the plastication by the rotation of the screw, the plastics will be metered through the backing of the screw by the pressure from the stored materials.

Therefore, for the injection screw for plastics, the end 6*a* of the screw flight 6 is needed to be positioned below rear edge 3*a* of the feeding opening 3 at the foremost position of the screw, as shown in FIG. 3. In this configuration, a screw groove 6*b* is needed to be always formed facing the feeding opening 3.

On the other hand, the metals are melted with external heat. The melted metals in liquid phase have low viscosity as differed from plastics. Therefore, the metals are transferred to the fore end of the heating cylinder by the rotation of the screw. However, since they cannot generate enough pressure to move the screw backward, the metering is performed by backing the screw mechanically and forcedly. The materials are transferred into the front of the heating cylinder by the rotation of the screw at the rearmost position of the screw.

In the injection molding of the metals as stated above, when the screw for injection molding of plastics is employed, as shown in FIG. 4, at the rearmost position of the screw, the rear end 6*a* of the screw flight 6 will be positioned behind the feeding opening 3. At the same time, the metals left in the screw groove 6*b* will be transferred and stay behind the feeding opening 3.

The materials left therein will be forwarded by the rotation of the screw. Since there is the feeding opening 3 before the left materials when the screw is in the rearmost position, the metal materials are additionally fed into the screw groove below the feeding opening 3. Therefore, the left materials have a tendency to stay therein, which impairs the screw rotation or sliding.

When the screw with the screw groove 6*b* always facing the feeding opening 3 is employed, the materials are ready for being transferred into the heating cylinder by the screw rotation regardless of screw position. Hence, when the screw is rotated for a purpose besides the plasticization, the screw groove 6*b* is fed and may be congested with the materials from the feeding opening 3. To prevent the congestion, feeding the materials into the feeding opening 3 is temporarily stopped, which causes inconvenience.

SUMMARY OF THE INVENTION

The present invention is aimed to solve the above-mentioned problems. An object of the present invention is to provide an injection screw for metals which allows to prevent the materials from being left, and reduce the friction of the screw rotation and sliding only by limiting the end position of the screw flight to a certain position according to the position of the feeding opening in the heating cylinder.

In order to achieve the above-mentioned object, the present invention provides an injection molding screw for metals, which is rotationally and movably provided in a heating cylinder having a nozzle at a tip end thereof, for transferring granular metals fed thereinside from a feeding opening at the rear of the heating cylinder while melting the metals, and for injecting the melted metals metered in the fore end of the heating cylinder from the nozzle by the forward movement of the screw, wherein a screw flight is formed around an axial portion of the screw, of which rear end is positioned below a rear edge of the feeding opening at the rearmost position of the screw in the heating cylinder, and wherein at the foremost position of the screw, the rear end thereof is positioned in front of the feeding opening in order to close the feeding opening by a rear portion of the axial portion of the screw.

With the screw as mentioned above, as the feeding opening is closed along with the forward movement of the screw by the axial portion, the congestion of the metals in the screw grooves at the end of the screw by automatically controlling the feeding of the materials when the injection starts. Thereby, the friction of the screw rotation and sliding decreases. The metals will be melted and injected steadily and the quality of the molded products will be improved.

The nature, principle, and utility of the invention will become more apparent from the following detailed description when read in conjunction with the accompanying drawings in which like parts are designated by like reference numerals or characters.

PREFERRED EMBODIMENTS OF THE INVENTION

Figure 1:
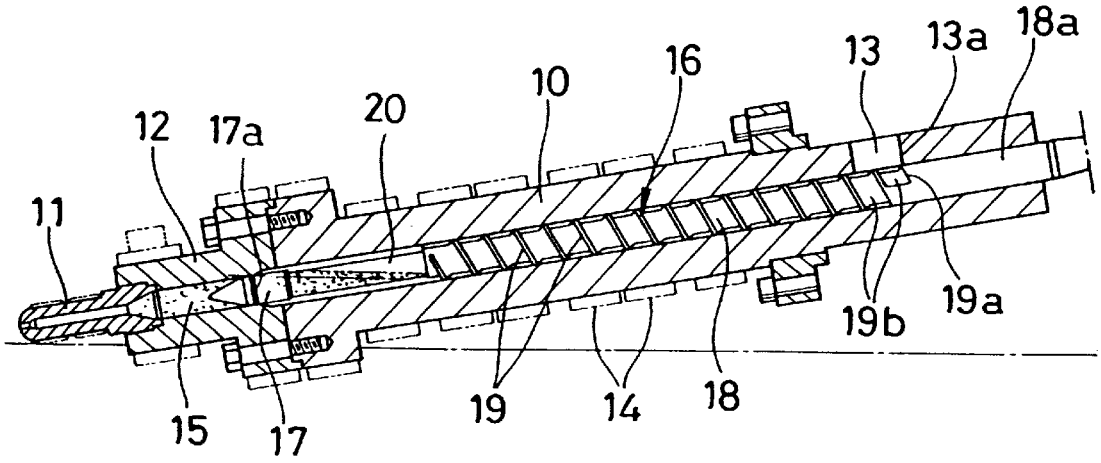
FIG. 1 is a longitudinal sectional side view illustrating an injection apparatus having an injection molding screw for metals according to the present invention at the rearmost position of the screw.
Figure 2:
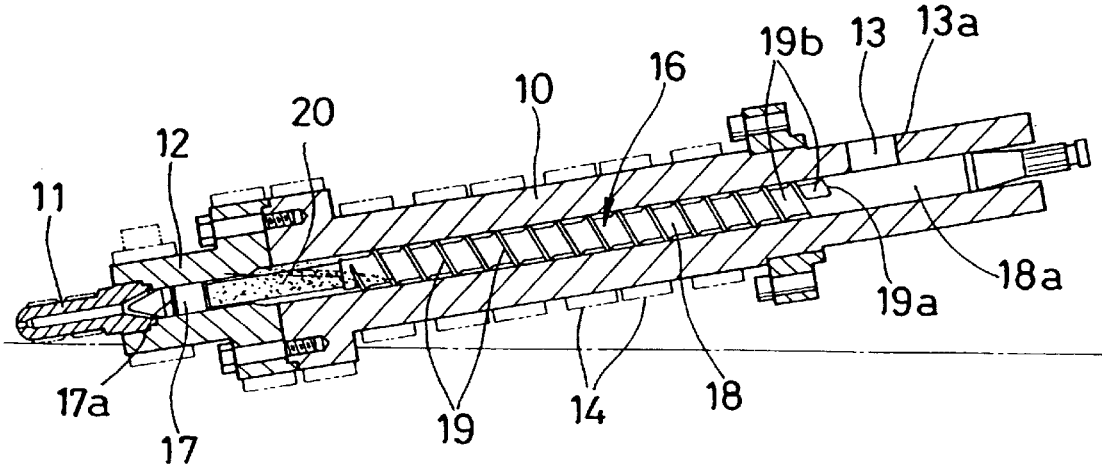
FIG. 2 is a longitudinal sectional side view illustrating the injection apparatus at the foremost position of the screw.
Figure 3:
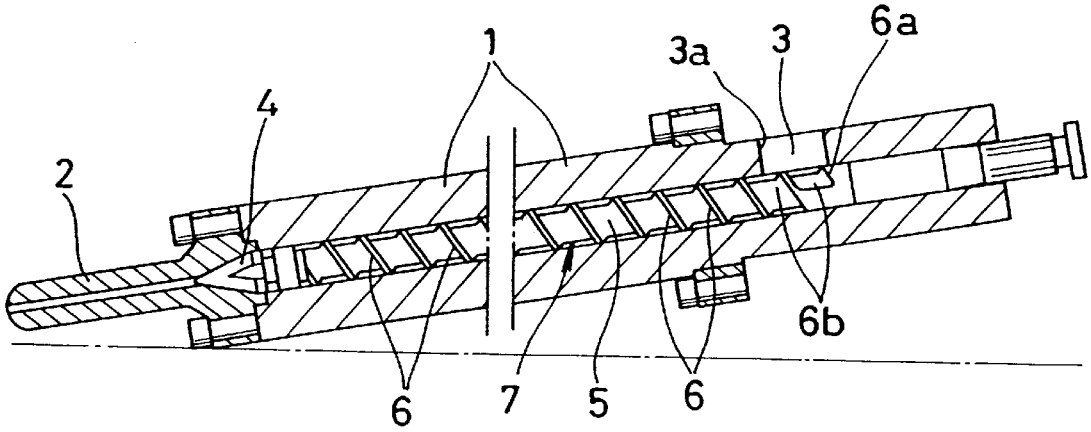
Fig. 3 PRIOR ART
FIG. 3 is a longitudinal sectional side view illustrating an injection apparatus having a conventional injection molding screw at the foremost position of the screw.
Figure 4:
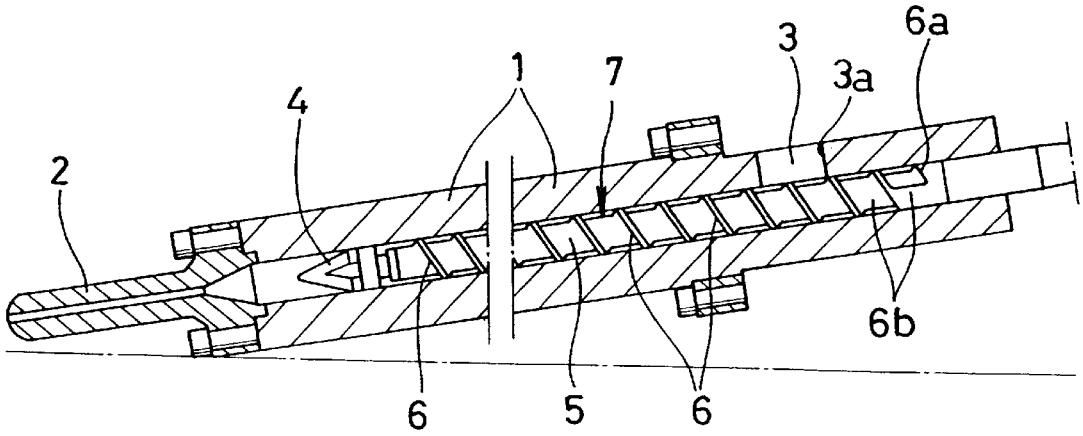
Fig. 4 PRIOR ART
FIG. 4 is a longitudinal sectional side view illustrating the conventional injection apparatus at the rearmost position of the screw.

FIGS. 1 and 2 show an embodiment of the injection apparatus of metals which employs the injection screw according to the present invention.

In figures, a reference numeral 10 denotes a heating cylinder which has a fore end member 12. On the fore end surface thereof, a nozzle member 11 is screwed. The heating cylinder 10 has a feeding opening 13 for granular metals at the rear portion thereof. Band heaters 14 are mounted at regular intervals around the nozzle member 11 and the heating cylinder 10 from the fore end member 12 to the feeding opening 13.

The diameter of the fore end member 12 communicating with the nozzle member 11 is smaller than the internal diameter of the heating cylinder 10 by 8–15%. A metering chamber 15 of the required length is formed in the fore end member of the heating cylinder 10.

In the heating cylinder 10, the injection screw 16 is provided rotationally and movably. The fore end of the injection screw 16 is formed into a plunger 17. The diameter of the plunger 17 is large enough to keep a clearance where the plunger 17 enters freely into the metering chamber 15. The plunger 17 has the conical surface at the fore end thereof which fits the funnel-shaped end surface of the metering chamber 15. In the circumference thereof a seal ring 17*a* is provided to prevent the materials from flowing backward from the clearance at injection. For the seal ring 17*a,* a piston ring of special steel with heat proof can be applied.

Around an axis 18 of the screw 16, screw flights 19 are formed. The external diameter of the screw flights 19 is almost equal to the internal diameter of the heating cylinder 10. They are formed on the axis of the same diameter at a constant pitch. The rear end 19*a* of the screw flight 19, as shown in FIG. 1, at the rearmost position of the screw in the heating cylinder 10, is positioned below the rear edge 13*a* of the feeding opening 13. Also as shown in FIG. 2, at the foremost position of the screw, the rear end 19*a* is positioned in front of the feeding opening 13 in order to close the feeding opening 13 by the rear portion 18*a* of the axial portion 18. The portion adjacent to the plunger 17 does not have screw flights for the required length to form a reservoir 20 to store the melted metals.

The injection apparatus in the construction stated above is used by being installed on a table with an inclination of an angle from 3 to 10 degrees and positioning the feeding opening 13 higher than the nozzle 11. Thereby, it allows the metals in liquid phase in the heating cylinder 10 to freely flow down and be stored into the fore end portion. The metals are melted by the band heaters 14 around the heating cylinder 10 (for example, the temperature for Mg is 610° C. or higher).

In the injection apparatus, the rear end 19*a* of the screw flights 19 is below the rear edge 13*a* of the feeding opening 13 and the screw groove 19*b* faces the feeding opening 13 at the rearmost position of the screw. After the screw 16 starts moving forward, the metals will not be fed additionally. During transferring the materials by the screw rotation, they will be melted with external heat. The melted materials will be stored in the fore end of the heating cylinder 10.

Therefore, the granular metals shortly stay in the screw groove 19*b*. As the result, the friction of the rotation and sliding caused from the congestion of the materials will be reduced which allows the screw 16 to move smoothly. Furthermore, the rotation torque of the screw 16 may become small according to the reduction of the friction of the rotation, where the motor power for driving the apparatus may be small.

After the screw 16 moves forward to the foremost position as shown in FIG. 2 and the injection of the melted metals stored in the metering chamber 15 is completed, the screw 16 moves to the rearmost position as shown in FIG. 1. The screw 16 does not rotate during moving forward and backward. When the screw 16 returns near the rearmost position, it starts rotating to feed the materials. The screw 16 rotates while it is in the rearmost position. The frequency of screw rotation defines the amount of the materials to be fed.

For some reasons, also it is necessary to rotate the screw 16 until the screw 16 reaches at the foremost or the rearmost position, the materials will not be fed by the screw rotation. Therefore, an excess feeding will be prevented. Thereby, the congestion of the materials in the screw grooves of the end of the screw is prevented so that the friction of the rotation and sliding of the screw will be reduced. As the result of it, the melting and injection of the metals will be steady and the quality of the molded products will be improved.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. An injection molding screw for metals, which is rotationally and movably provided in a heating cylinder having a nozzle at an end thereof and a feeding opening at a rear thereof, said injection molding screw configured to transfer granular metals, fed thereinside from the feeding opening of the heating cylinder, while said metals are melted and to inject melted metals, metered in a fore end of the heating cylinder, from the nozzle by forward movement of the screw, the heating cylinder and the screw positioned at an inclination with the feeding opening disposed higher than the nozzle, wherein:

a screw flight is formed around a portion of the axis of the screw and a remainder section of the screw is of a diameter equal to the outer diameter of the screw flight;

a rearmost end of said screw flight is positioned immediately below a rear edge of the feeding opening when said screw is at a rearmost position in the heating cylinder, wherein said granular metals are fed through the feeding opening by rotation of the screw when the rearmost end of said screw flight is at the rearmost position; and at a foremost position of the screw, the rear end of said screw flight is positioned forward of the feeding opening and the feeding opening is closed by said remainder section of the screw.

2. An injection molding screw apparatus for injecting melted metals, comprising:

a heating cylinder, the heating cylinder having a feeding opening at a rear end and a nozzle at a fore end, the heating cylinder disposed at an inclination with the feeding opening disposed higher than the nozzle; and an injection molding screw rotationally and translatably disposed within the heating cylinder, the injection molding screw operative to transfer granular metals from the feeding opening while the metals are melted in the heating cylinder and to inject the melted metals, metered in a fore end of the heating cylinder, by forward movement, the injection molding screw further comprising:

an axial shaft, a screw flight formed around a portion of the axial shaft, and a remainder section of the axial shaft disposed rearwardly of the screw flight, the remainder portion having a diameter equal to an outer diameter of the screw flight;

wherein the injection molding screw is disposed for translation within the heating cylinder such that in a rearmost position, a rearmost end of the screw flight is positioned immediately below a rear edge of the feeding opening when said screw is at a rearmost position in the heating cylinder, wherein said granular metals are fed through the feeding opening by rotation of the screw when said screw flight is at the rearmost position, and in a foremost position, the rear end of the screw flight is positioned forward of the feeding opening and the feeding opening is closed by the remainder section of the axial shaft.

* * * * *

UNITED STATES PATENT AND TRADEMARK OFFICE

CERTIFICATE OF CORRECTION

PATENT NO. : 6,679,312 B2
DATED : January 20, 2004
INVENTOR(S) : Yuji Hayashi et al.

It is certified that error appears in the above-identified patent and that said Letters Patent is hereby corrected as shown below:

Title page,
Item [75], Inventors, should read as follows:
-- Yuji Hayashi, Nagano-Ken (JP); Mamoru Miyagawa, Nagano-Ken (JP) --.

Signed and Sealed this

Twenty-second Day of March, 2005

JON W. DUDAS
*Director of the United States Patent and Trademark Office*